US006842589B2

(12) United States Patent
Ikeda

(10) Patent No.: US 6,842,589 B2
(45) Date of Patent: Jan. 11, 2005

(54) METHOD AND IMAGE FORMING APPARATUS PRODUCING TONER PATTERN WITHOUT ADHESION OF TONER TO SEPARATION PICK

(75) Inventor: Yoshito Ikeda, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 501 days.

(21) Appl. No.: 10/102,853

(22) Filed: Mar. 22, 2002

(65) Prior Publication Data

US 2002/0145761 A1 Oct. 10, 2002

(30) Foreign Application Priority Data

Mar. 22, 2001 (JP) ..... 2001-083910

(51) Int. Cl.[7] ..... G03G 15/00
(52) U.S. Cl. ..... 399/49; 399/72
(58) Field of Search ..... 399/38, 46, 49, 399/72

(56) References Cited

U.S. PATENT DOCUMENTS 5,253,031 A * 10/1993 Kinoshita et al. ..... 399/72
5,576,811 A * 11/1996 Kobayashi et al. ..... 399/60
5,694,637 A * 12/1997 Yoshino et al. ..... 399/38
6,181,888 B1 * 1/2001 Scheuer et al. ..... 399/49

FOREIGN PATENT DOCUMENTS

| | | |
|---|---|---|
| JP | 62-124579 | 6/1987 |
| JP | 10-149009 | 6/1998 |
| JP | 10-228164 | 8/1998 |
| JP | 11-024383 | 1/1999 |

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus includes a data processing device to process image information. A latent image forming device forms an electrostatic first latent image on a surface of a photoconductive element based on image data processed by the data processing device and forms an electrostatic second latent image on the photoconductive element. A developing device develops the first and second electrostatic latent with toner. The first latent image is transferred from the surface of the photoconductive element to a transfer sheet, and the transfer sheet is separated from the surface of the photoconductive element by a separation pick. And, the second latent image has a pattern not produced in a portion of the surface of the photoconductive element that corresponds to the separation pick.

15 Claims, 6 Drawing Sheets

METHOD AND IMAGE FORMING APPARATUS PRODUCING TONER PATTERN WITHOUT ADHESION OF TONER TO SEPARATION PICK

BACKGROUND OF THE INVENTION

1. Field of the Invention

The present invention relates to a method and an image forming apparatus, such as a copying machine, a facsimile, a printer, and other similar devices, and more particularly to a method and an image forming apparatus that can produce a toner pattern for adjusting a density of toner and/or prevent a cleaning blade from being caught up while preventing an adhesion of the toner to a separation pick.

2. Discussion of the Background

In an electrophotographic image forming apparatus, an electrostatic latent image is formed on a surface of a photoconductive element. The electrostatic latent image is developed into a visible image with toner. The visible toner image is then transferred onto a transfer sheet to form an image on the transfer sheet. In the above-described image forming apparatus, residual toner remaining on the surface of the photoconductive element after the toner image has been transferred is removed by a cleaning device.

Conventionally, in the cleaning device the residual toner is scraped by press-contacting a rubber tip edge of a cleaning blade with the surface of the photoconductive element. However, a friction coefficient between the surface of the photoconductive element and the cleaning blade increases when a film layer of minute toner is formed by heat and pressure on the surface of the photoconductive element. Thus, it may happen that the cleaning blade is caught-up by the photoconductive element. To prevent the above-described phenomenon, a toner pattern (i.e., a cleaning blade caught-up inhibiting pattern) is generally produced on the surface of the photoconductive element to reduce the friction coefficient by adhering toner of the toner pattern to the tip edge of the cleaning blade.

In addition, in a background image forming apparatus, a toner pattern is produced on the surface of the photoconductive element. A density of the toner pattern is detected by a sensor. Then, the density of the toner is adjusted based on the detected value to prevent degradation of an image quality due to background fouling toner and a scattering of the toner inside the apparatus.

In a method for adjusting the density of toner, a latent image is formed in a non-image region of the surface of the photoconductive element. The latent image is then visualized with toner. Thus, the toner is forcibly consumed to achieve a desired toner density. Hence, a toner pattern produced for toner density detection and adjustment is also used as the toner pattern for preventing a cleaning blade from being caught-up.

In Japanese Patent Laid-Open Publication No. 10-228164, a technology for using a toner pattern produced for a detection and adjustment of a toner density also for preventing a cleaning blade from being caught-up is disclosed. In Japanese Patent Laid-Open Publication No. 11-024383, a technology for stabilizing a density of toner by performing a forcible toner consuming operation is disclosed. To be more specific, the cleaning blade caught-up inhibiting pattern is produced in a form of a continued latent image in a main scanning direction of a photoconductive element having a length equal to that of a cleaning blade. As described above, a main objective of producing the cleaning blade caught-up inhibiting pattern is to reduce a friction coefficient between the surface of the photoconductive element and the cleaning blade by using toner of the pattern as a lubricant. Thus, an excessive amount of toner is not used for the production of the cleaning blade caught-up inhibiting pattern.

When consuming toner by producing the cleaning blade caught-up inhibiting pattern, the amount of toner to be consumed is adjusted by adjusting a length of the cleaning blade caught-up inhibiting pattern in a sub-scanning direction. Thus, when a size of the cleaning blade caught-up inhibiting pattern is increased in the sub-scanning direction, the amount of the consumed toner is increased.

However, the production of the cleaning blade caught-up inhibiting pattern results in an adhesion of toner to a separation pick that separates a transfer sheet from a photoconductive element. As a result, the separation pick may not properly function.

SUMMARY OF THE INVENTION

The present invention has been made in view of the above-mentioned and other problems and addresses the above-discussed and other problems.

The present invention advantageously provides an electrophotographic image forming apparatus and a method, in which a toner pattern for adjusting a density of toner and/or preventing a cleaning blade from being caught-up is produced while preventing an adhesion of the toner to a separation pick to avoid improper functioning of the separation pick.

According to an example of the present invention, an image forming apparatus includes a data processing device configured to process image information, a latent image forming device configured to form an electrostatic latent image on a surface of a photoconductive element based on image data processed by the data processing device and configured to form a second latent image on the surface of the photoconductive, and a developing device configured to develop the first and second electrostatic latent. Further, the first latent image is transferred from the surface of the photoconductive element to a transfer sheet, and the transfer sheet is separated from the surface of the photoconductive element by a separation pick, and the second latent image has a pattern not produced in a portion of the surface of the photoconductive element that corresponds to the separation pick.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
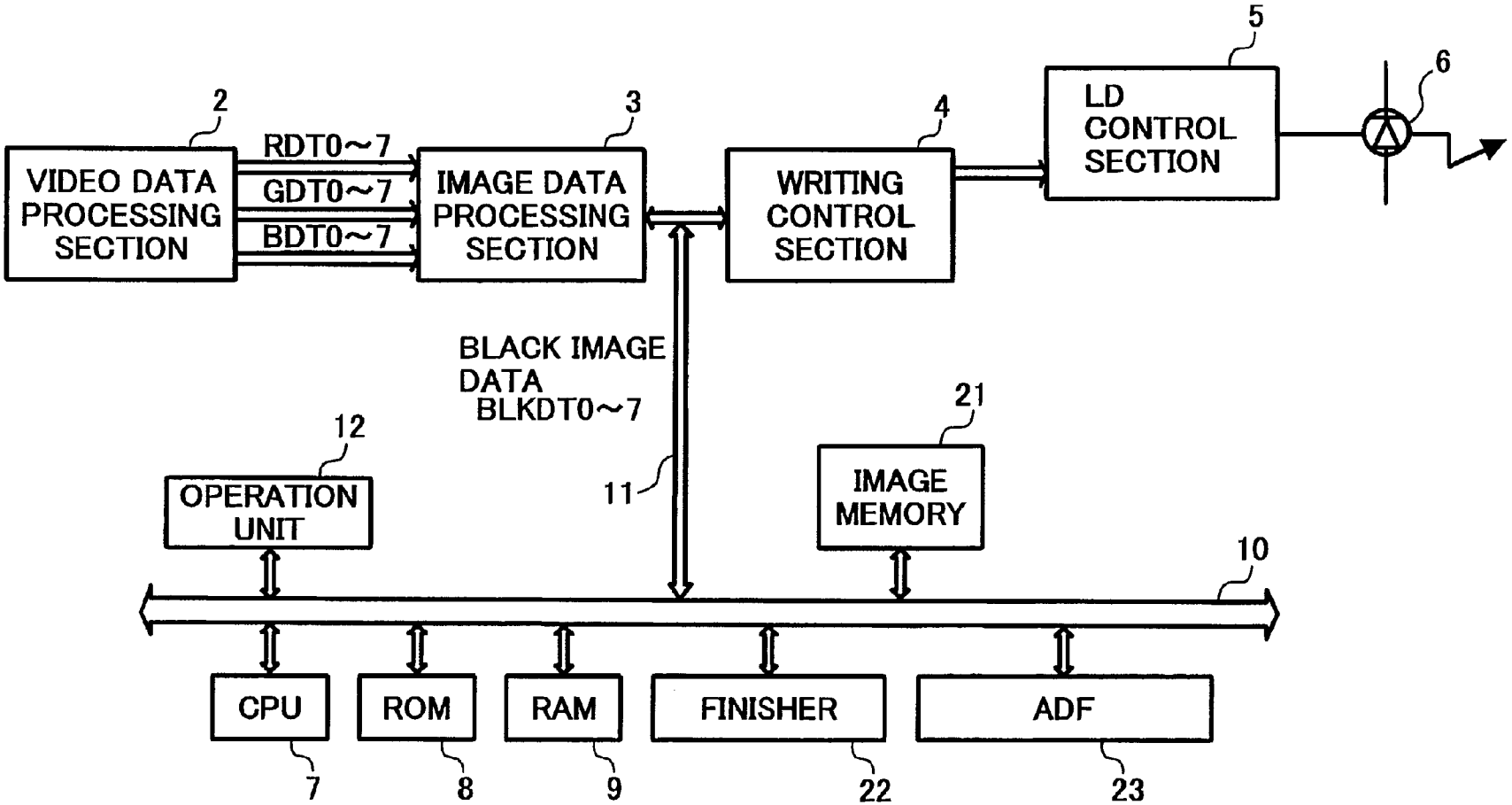
FIG. 1 is a block diagram illustrating a composition of sections that mainly relate to image processing in a control section of a digital copying machine as an example of an image forming apparatus according to the present invention.

Referring now to the drawings, wherein like reference numerals designate identical or corresponding parts throughout the several views, an example of an image forming apparatus according to the present invention is described below.

Figure 2:
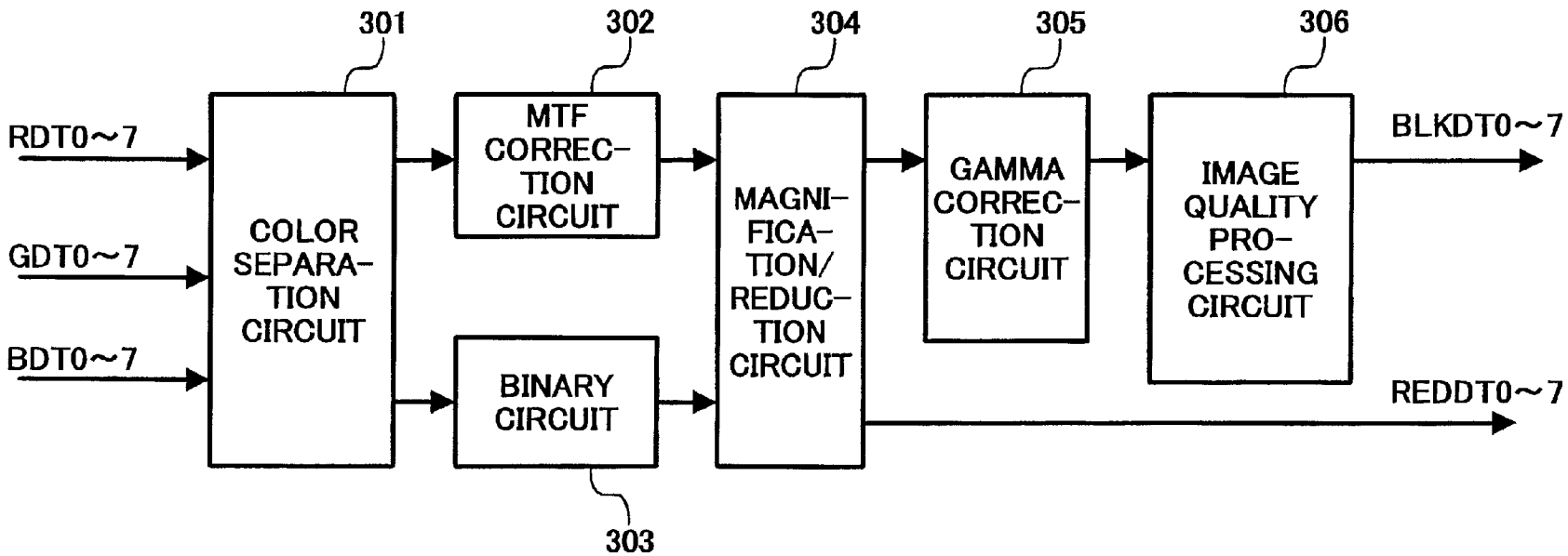
FIG. 2 is a block diagram illustrating a composition of an image data processing section in FIG. 1.
Figure 3:
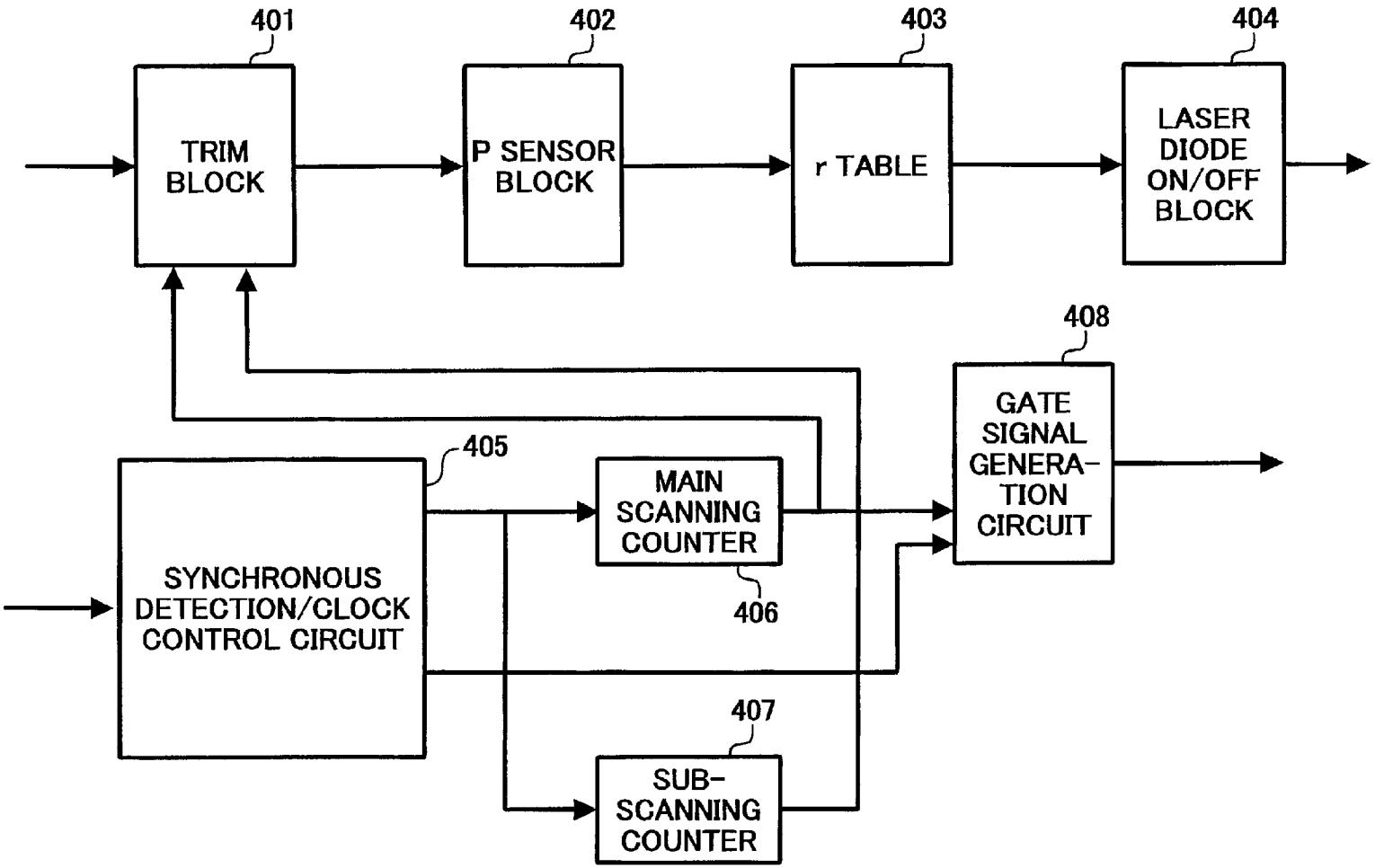
FIG. 3 is a block diagram illustrating a construction of a writing control section.

A digital copying machine is described as an example of the image forming apparatus, although the present invention is clearly applicable to other types of image forming apparatuses. FIG. 1 is a block diagram illustrating a composition of sections that mainly relate to image processing in a control section of the digital copying machine. FIG. 2 is a block diagram illustrating a composition of an image data processing section 3 in FIG. 1. FIG. 3 is a block diagram illustrating a construction of a writing control section 4.

In FIG. 1, an image processing section includes a video data processing section 2, the image data processing section 3, the writing control section 4, and a LD control section 5. The video data processing section 2 converts an analog RGB (Red, Green, and Blue) image signal, which is generated by reading an image of an original document by a scanner (which is described below referring to FIG. 4), into a digital signal. The video data processing section 2 then performs a black offset correction, a shading correction, and a pixel position correction. The image data processing section 3 performs an image process on the RGB image data output from the video data processing section 2. The writing control section 4 performs an image forming process based on the image data output from the image data processing section 3. The LD control section controls a light emission of a laser diode 6, which can be a semiconductor laser, based on the signal output from the writing control section 4.

The RGB image signal generated by reading an original image with a CCD of the scanner is converted into a digital signal while a proper gain is given. The signal is then output as digital data RDT0~7, GDT0~7, and BDT0~7 of 8 bits synchronized with a clock, after the black offset correction, the shading correction, and the pixel position correction are performed. In this case, the black offset correction operation includes a correction in which a black level of a dark current of a CCD is subtracted from image data. The shading correction is performed to correct an error generated due to uneven radiation of a light source in a main scanning direction and a variation in a sensitivity of a CCD in each pixel.

Before scanning an original image, a white plate having a uniform density is read. Image data acquired by reading the white plate is stored for each pixel. The shading correction is performed by dividing image data of the original image by the stored image data of each pixel. The pixel position correction is performed to correct a shifting of a pixel to a sub-scanning direction created when CCDs are employed in 3 lines.

The writing control section 4 performs operations, such as converting a transmission speed of image data into a writing speed to a printer, and supplying data necessary for a printing operation. The LD control section 5 controls a current pulse width and a current amount supplied to the laser diode 6 based on black image data of 8 bits having 256 levels of gray. The control section of the digital copying machine illustrated in FIG. 1 includes a CPU 7, a ROM 8, a RAM 9, and an image memory 21. The CPU 7 exerts control over an overall operation of the apparatus. The ROM 8 stores various types of fixed data including a control program. The RAM 9 is temporarily used when data is processed by the control program. The image memory 21 stores image data transmitted from the image data processing section 3.

The control section further includes a system bus 10 through which data transmission among devices is performed. An I/F (interface) 11 is an interface between the system bus 10 and the image data processing section 3. An operation unit 12 displays various types of indications for an operation. The operator inputs operating instructions through the operation unit 12. A finisher 22 and an automatic document feeder (ADF) 23 are connected to the system bus 10.

FIG. 2 is a block diagram illustrating each block of the image data processing section 3 in FIG. 1. In the image data processing section 3, each signal of RGB is input to a color separation circuit 301 to extract black image data and red image data. Then, the black image data is subjected to a MTF (Modulation Transfer Function) correction in a MTF correction circuit 302. Namely, a degradation of optical frequency characteristics, etc., is corrected by a two-dimensional spatial filter. The read image data is binarized by a binary circuit 303. The magnification/reduction circuit 304 performs an electrical scaling on the read image data in a main scanning direction. The read image is then subjected to a γ compensation in a γ correction circuit 305. Further, the read image is subjected to dither and error diffusion processing in an image quality processing circuit 306. Black image data BLKDT0~7 subjected to the various types of corrections in the image data processing section 3 is transmitted to the writing control section 4 in FIG. 1. The black image data BLKDT0~7 is stored in the image memory 21 as necessary through the I/F 11.

The image data processing section 3 and the CPU 7 communicate with each other while sharing an address bus and a data bus. The control section of the digital copying machine controls a motor of a scanner and a printer, and various types of clutches and solenoids (not shown).

FIG. 3 is a block diagram illustrating a composition of the writing control section 4 in FIG. 1. Black image data transmitted from the image data processing section 3 is trimmed by a trim block 401. A P sensor pattern, which is used in a process control, and a cleaning blade caught-up inhibiting pattern are supplied to the black image data in a P sensor block 402. A γ table 403 changes a weight of the black image data. Further, a laser diode ON/OFF block 404 supplies laser diode compulsory lighting data to the black image data for a synchronous detection. Then, the LD control section 5 in FIG. 1 controls driving of the laser diode 6.

A test pattern is formed in combination of two count values counted by a main scanning counter 406 and a sub-scanning counter 407. The main scanning counter 406 is cleared by a synchronous detection signal transmitted from a synchronous detection/clock control circuit 405 and counts up by a pixel clock CLK whenever necessary. The sub-scanning counter 407 is cleared by a FGATE (i.e., a frame gate signal) and counts up by the synchronous detection signal whenever necessary. The trim block 401 selects either the test pattern data or image sensor data, and transmits the selected data to the P sensor block 402 after the data is masked in a trimming region.

Similarly, the P sensor pattern and the cleaning blade caught-up inhibiting pattern are formed in combination of the above-described counted values of the two counters. As a detailed example, gate signals in a main scanning direction and a sub-scanning direction are generated by each of the counted values in a gate signal generation circuit 408. The pattern is formed by the logical conjunction. In practice, when the counted value of the main scanning counter 406 reaches a desired value, a mask operation is performed not to generate the gate signal in the main scanning direction that produces the cleaning blade caught-up inhibiting pattern while continuously monitoring the main scanning counter 406. Thus, a latent image to be transferred onto a recording medium is not formed at a non-image timing of a photoconductive element. Hence, a non-image forming timing is set in the photoconductive element where no latent image to be transferred onto a recording medium is formed.

The above-described desired counted value of the main scanning counter 406 can be set at an arbitrary numerical value through the operation unit 12 in a special mode referred to as a SP mode. Thus, the cleaning blade caught-up inhibiting pattern is produced by the P sensor block 402 (which has a latent image providing function) based on each counted value of the main scanning counter 406 and sub-scanning counter 407.

Figure 4:
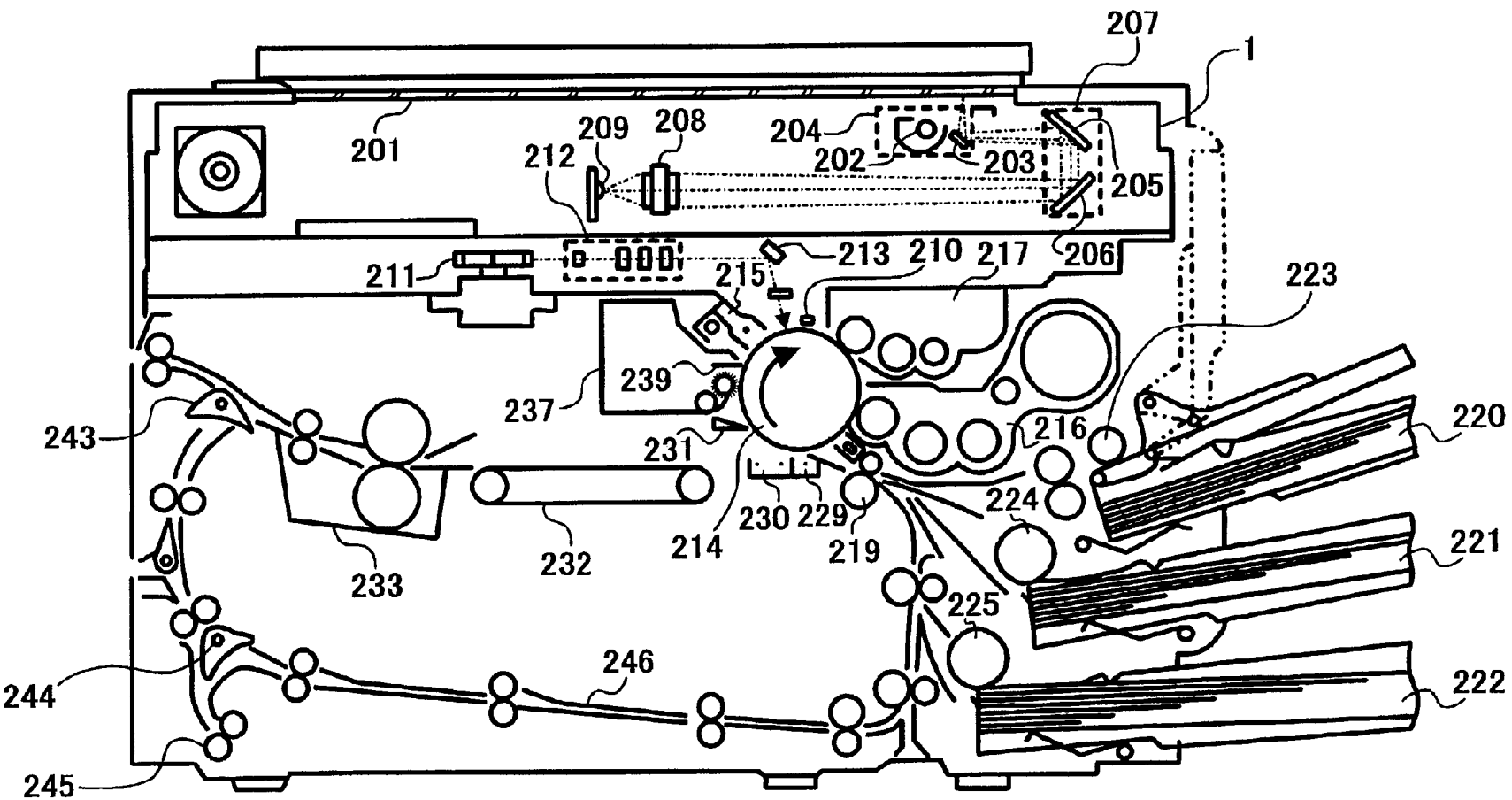
FIG. 4 is a schematic drawing illustrating a construction of the digital copying machine.

FIG. 4 is a schematic drawing illustrating an overall construction of the digital copying machine. The digital copying machine includes a scanner 1 and an image forming section. The scanner 1 provided on the top of the apparatus includes a platen 201 on which an original document to be read is placed. Under the platen 201, a light source (e.g. a fluorescent lamp) 202, and a carriage 204 including a mirror 203 are movably provided in a horizontal direction (i.e., in a sub-scanning direction). The mirror 203 reflects reflected light from the original document in a horizontal direction. A carriage 207 including mirrors 205 and 206 is provided such that it can move according to a movement of the carriage 204. The mirror 205 reflects light reflected from the mirror 203 at a 90° angle and the mirror 206 reflects the reflected light from the mirror 205 at a 90° angle. A lens 208 is arranged in an emerging optical path of the mirror 206. A line image sensor 209 is arranged at a position where the light passed through the lens 208 is focused.

The image forming section is provided under the scanner 1. The image forming section includes a laser beam generator 211 including a rotating deflector, a writing device including an optical system 212 and a mirror 213, and a photoconductive drum 214. The optical system 212 focuses a laser beam emitted from the laser beam generator 211 onto a predetermined position. The mirror 213 reflects the laser beam emitted from the optical system 212. Around the photoconductive drum 214 are disposed a charger 215, a LED light generator 210, developing devices 216 and 217, a registration roller 219, a transfer charger 229, a separation charger 230, a separation pick 231, a cleaning unit 237, and a cleaning blade 239.

In addition, a registration roller 219, sheet feeding cassettes 220, 221, and 222, sheet feeding rollers 223, 224, and 225, a sheet conveying unit 232, a fixing device 233, and a sheet feeding path for a synthesis printing including a both sides synthesis switching pick 243, a reverse switching pick 244, a reversing roller 245, and a jogger unit 246 are arranged in the image forming section.

The registration roller 219 feeds a transfer sheet to a transfer position of the photoconductive drum 214 by adjusting the feed timing. The sheet feeding cassettes 220, 221, and 222 accommodate a large number of transfer sheets. The sheet feeding rollers 223, 224, and 225 feed the transfer sheets sheet-by-sheet from the respective sheet feeding cassettes 220, 221, and 222.

In the image forming section, the charger 215 uniformly charges a surface of the photoconductive drum 214. The charged surface of the photoconductive drum 214 is exposed with a laser beam modulated by the writing unit according to image data. Thus, an electrostatic latent image is formed on the surface of the photoconductive drum 214. An unnecessary portion of the electrostatic latent image is eliminated by LED light irradiated by the LED light generator 210. The electrostatic latent image is developed with black toner by the developing device 216 or with color toner by the developing device 217.

The registration roller 219 feeds a transfer sheet, which is fed from one of sheet feeding cassettes 220, 221, and 222, to the transfer position of the photoconductive drum 214 by adjusting the feeding timing to correspond to the timing that the toner image on the surface of the photoconductive drum 214 reaches the transfer position. Thus, the toner image is transferred onto the transfer sheet by the transfer charger 229. The transfer sheet having the toner image thereon is separated from the photoconductive drum 214 starting from a leading edge of the transfer sheet by the separation charger 230 and separation pick 231. The transfer sheet is then conveyed to the fixing device 233 by the sheet conveying unit 232. The toner image is fixed onto the transfer sheet by heat and pressure by the fixing device 233. Residual toner remaining on the surface of the photoconductive drum 214 after the transfer sheet has been separated is removed by the cleaning unit 237 and cleaning blade 239.

Figure 5A:
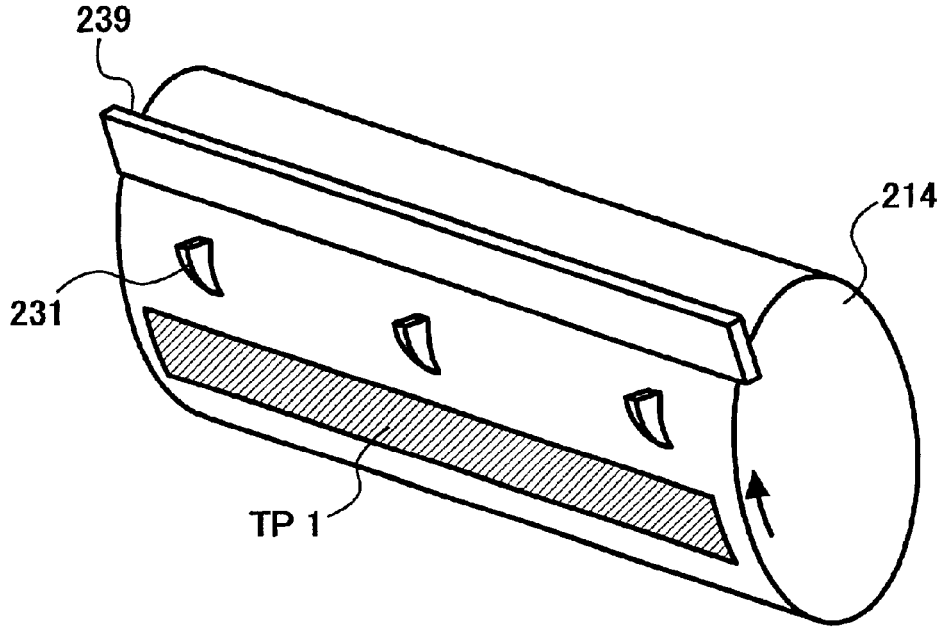
FIGS. 5A and 5B are drawings illustrating a perspective view of a toner pattern produced on a surface of a photoconductive drum; a background toner pattern is illustrated in FIG. 5A while a toner pattern according to the present invention is illustrated in FIG. 5B.
Figure 5B:
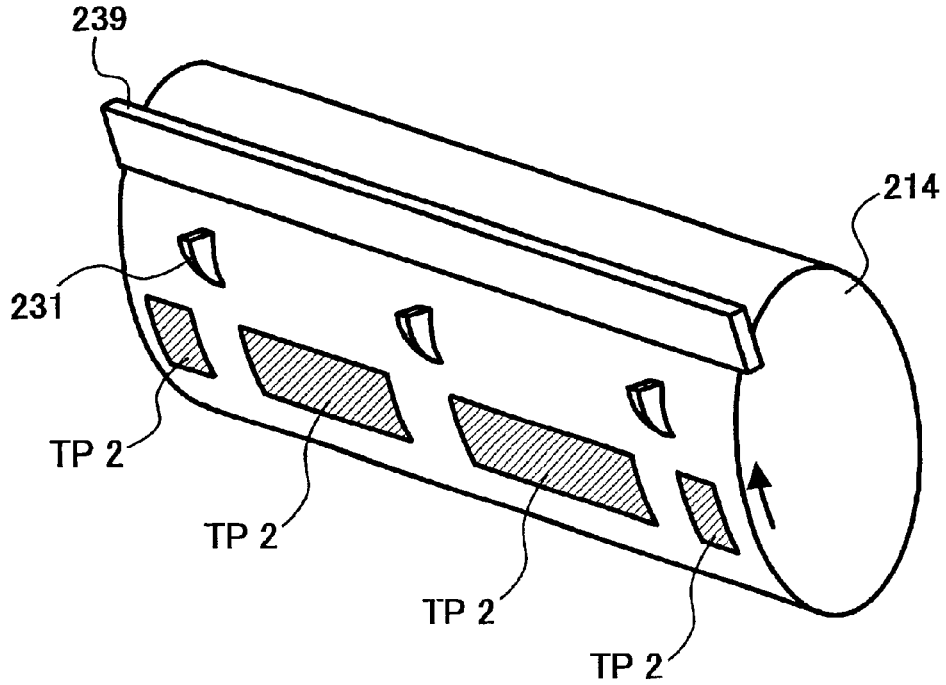

FIGS. 5A and 5B are drawings illustrating toner patterns with respect to a photoconductive drum, a cleaning blade, and a separation pick. In the description of the circuit composition for the image processing, the circuitry in the image data processing sections, and the circuitry in the writing control section referring to FIGS. 1 to 3, the black image data and the cleaning blade caught-up inhibiting pattern have been discussed.

FIGS. 5A and 5B are simplified drawings illustrating toner patterns TP1, TP2 that are cleaning blade caught-up inhibiting patterns to be produced on the surface of the photoconductive drum 214, the separation pick 231, and the cleaning blade 239 in the background art and the present invention, respectively. Based on the cleaning blade caught-up inhibiting pattern set in both main and sub-scanning directions by the writing control section 4 in FIG. 1, a region of a surface of the photoconductive drum 214 is irradiated and exposed with a laser beam at a non-image forming timing to form an electrostatic latent image thereon so that the toner patterns TP1, TP2, with which a density adjustment is made, are produced with black toner by the developing device 216. Thus, the toner patterns TP1, TP2 illustrated in FIGS. 5A and 5B are formed.

FIG. 5A shows a background toner pattern TP1. FIG. 5B shows the toner pattern TP2 produced in the digital copying machine of the present invention. In the background art, the toner pattern TP1 is uniformly produced in a main scanning direction.

According to the example of the present invention, the toner pattern TP2, as the cleaning blade caught-up inhibiting pattern, is not produced in a portion of the surface of the photoconductive drum 214 that corresponds to the separation pick 231. Thus, an adhesion of the toner of the toner pattern TP2 to the separation pick 231 with a rotation of the photoconductive drum 214 is prevented. Namely, the toner pattern TP2 of the present invention is produced on the portions of the surface of the photoconductive drum 214 other than the portions thereof that correspond to the position of the separation pick 231. The cleaning blade caught-up inhibiting pattern TP2 is produced by the writing control section 4 when the FGATE output is switched and a non-image timing is set. Based on the cleaning blade caught-up inhibiting pattern TP2 produced by the writing control section 4, the LD control section 5 is controlled and an electrostatic latent image is formed on the surface of the photoconductive drum 214.

Figure 6:
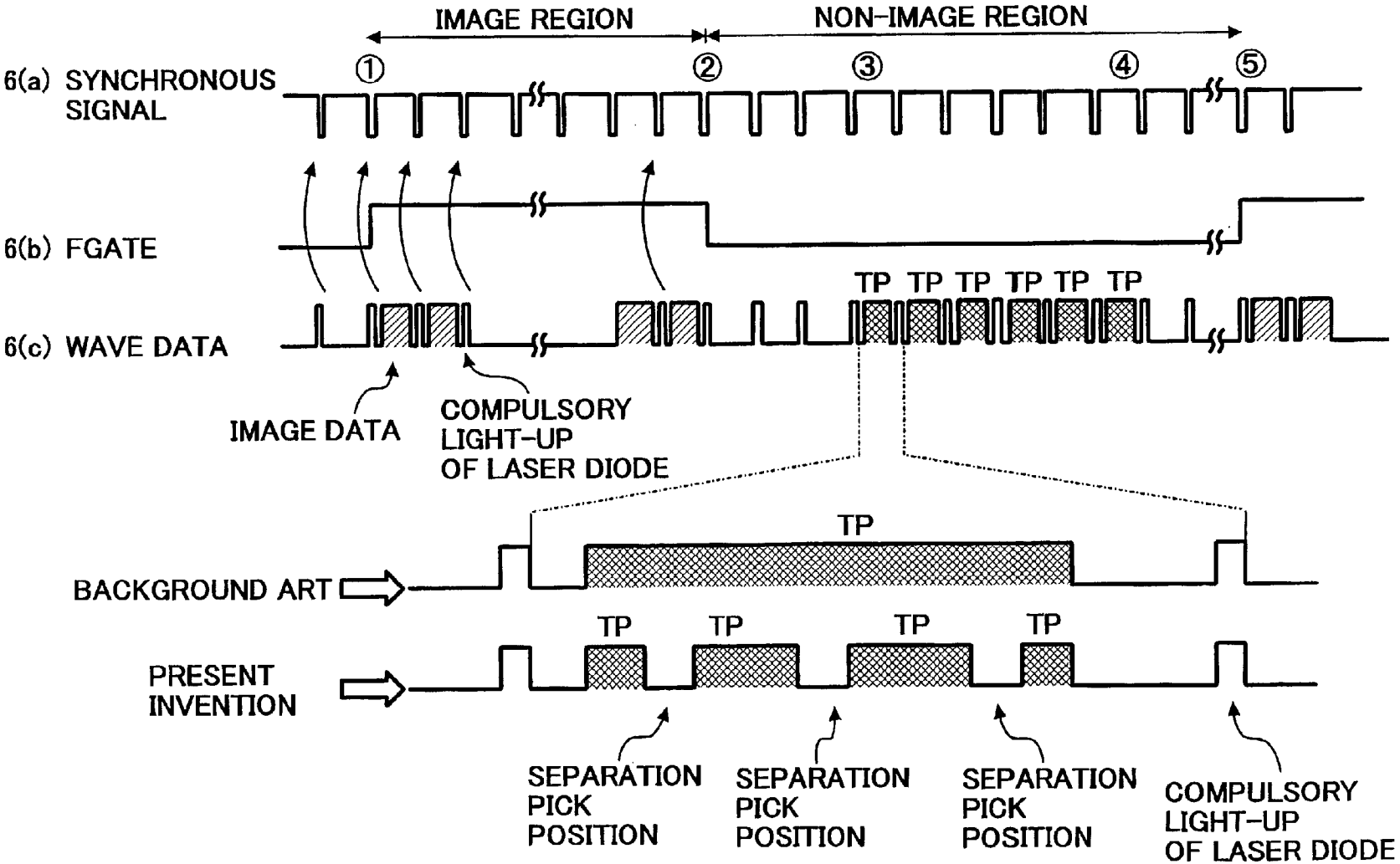
FIG. 6 is a timing diagram for producing a cleaning blade caught-up inhibiting pattern in the digital copying machine in FIG. 4.

FIG. 6 is a timing diagram illustrating a production of the cleaning blade caught up inhibiting pattern. In FIG. 6, 6(*a*) explains a synchronous signal in a main scanning direction; 6(*b*) explains the FGATE output showing that a printing operation is being performed (i.e., FGATE=H) or the printing operation is finished (i.e., FGATE=L); and 6(*c*) explains light wave data acquired by the laser.

Operations ① to ⑤ that are performed in time sequence are now described. ①: A printing operation is performed after the synchronous signal is ensured (i.e., FGATE=H). ②: The printing operation is finished (i.e., FGATE=L). ③: A production of a toner pattern on a surface of a photoconductive drum is started. ④: The production of the toner pattern on the surface of the photoconductive drum is completed. ⑤: The printing operation is started.

In addition, toner patterns produced in the background art and that produced according to the example of the present invention are illustrated in FIG. 6.

In the present invention at an image forming timing or region a first electrostatic latent image is formed on the surface of the photoconductive drum (noted in FIG. 6 as the "image region"), and the first electrostatic latent image is later transferred to a recording medium. At a non-image forming timing or region switched to by the FGATE output, a second electrostatic toner image is formed on the surface of the photoconductive drum (noted in FIG. 6 as the "non-image region"). The portion on the surface of the photoconductive drum on which the first and second latent images are formed can be the same area, but the timing of forming the first and second electrostatic latent images differs. The second electrostatic latent image is the cleaning blade caught-up inhibiting pattern TP2 noted above, which is not transferred to a recording medium.

The example of the present invention that is applied to a digital copying machine is described above; however, the present invention is not limited to being applied to a digital copying machine. The present invention can generally be applied to various types of electrophotographic image forming apparatuses, such as a laser printer, a plain-paper facsimile, and other similar devices.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2001-083910, filed on Mar. 22, 2001, the entire contents of which are hereby incorporated herein by reference.

What is claimed as new and is desired to be secured by Letters Patent of the United Stated is:

1. An image forming apparatus, comprising:

a data processing device configured to process image information;

a latent image forming device configured to form an electrostatic first latent image on a surface of a photoconductive element based on image data processed by the data processing device, and configured to form an electrostatic second latent image on the surface of the photoconductive element; and a developing device configured to develop the first and second electrostatic latent images with toner;

wherein the first latent image is transferred from the surface of the photoconductive element to a transfer sheet, and the transfer sheet is separated from the surface of the photoconductive element by a separation pick, and the second latent image has a pattern not produced in a portion of the surface of the photoconductive element that corresponds to the separation pick.

2. The image forming apparatus according to claim 1, wherein the second latent image extends in a main scanning direction.

3. The image forming apparatus according to claim 1, wherein the second latent image includes a plurality latent image portions extending in a main scanning direction.

4. The image forming apparatus according to claim 1, wherein the second latent image includes a cleaning blade caught-up inhibiting pattern.

5. The image forming apparatus according to claim 1, wherein the second latent image includes a toner pattern used for adjusting a density of toner.

6. An image forming apparatus, comprising:

data processing means for processing image information;

latent image forming means for forming an electrostatic first latent image on a surface of a photoconductive element based on image data processed by the data processing means, and for forming an electrostatic second latent image on the surface of the photoconductive element; and developing means for developing the first and second electrostatic latent images with toner;

wherein the first latent image is transferred from the surface of the photoconductive element to a transfer sheet, and the transfer sheet is separated from the surface of the photoconductive element by a separation pick, and the second latent image has a pattern not produced in a portion of the surface of the photoconductive element that corresponds to the separation pick.

7. The image forming apparatus according to claim 6, wherein the second latent image extends in a main scanning direction.

8. The image forming apparatus according to claim 6, wherein the second latent image includes a plurality of latent image portions extending in a main scanning direction.

9. The image forming apparatus according to claim 6, wherein the second latent image includes a cleaning blade caught-up inhibiting pattern.

10. The image forming apparatus according to claim 6, wherein the second latent image includes a toner pattern used for adjusting a density of toner.

11. A method for forming an image, comprising:

processing image information;

forming an electrostatic first latent image on a surface of a photoconductive element based on image data processed in the image information processing, and forming an electrostatic second latent image on the surface of the photoconductive element;

developing the first and second electrostatic latent images with toner;

wherein the first latent image is transferred from the surface of the photoconductive element to a transfer sheet, and the transfer sheet is separated from the surface of the photoconductive element by a separation pick, and the second latent image has a pattern not produced in a portion of the surface of the photoconductive element that corresponds to the separation pick.

12. The method according to claim 11, further comprising:

arbitrarily setting the second latent image extending in a main scanning direction.

13. The method according to claim 11, further comprising:

setting for the second latent image a plurality latent image portions extending in a main scanning direction.

14. The method according to claim 11, wherein the second latent image includes a cleaning blade caught-up inhibiting pattern.

15. The method according to claim 11, wherein the second latent image includes a toner pattern used for adjusting a density of toner.

* * * * *